US008912871B2

(12) United States Patent
Lauraire et al.

(10) Patent No.: US 8,912,871 B2
(45) Date of Patent: Dec. 16, 2014

(54) ELECTROMAGNETIC ACTUATOR WITH MAGNETIC LATCHING AND SWITCHING DEVICE COMPRISING ONE SUCH ACTUATOR

(75) Inventors: Michel Lauraire, Saint Maur des Fosses (FR); Jean Pierre Kersusan, Vif (FR); Bernard Loiacono, Seyssinet (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 13/516,538

(22) PCT Filed: Nov. 15, 2010

(86) PCT No.: PCT/FR2010/000760

§ 371 (c)(1),
(2), (4) Date: Jun. 15, 2012

(87) PCT Pub. No.: WO2011/073539

PCT Pub. Date: Jun. 23, 2011

(65) Prior Publication Data

US 2012/0293287 A1 Nov. 22, 2012

(30) Foreign Application Priority Data

Dec. 18, 2009 (FR) ..... 09 06168
Sep. 30, 2010 (FR) ..... 10 03875

(51) Int. Cl.

| | |
|---|---|
| ***H01F 7/00*** | (2006.01) |
| ***H01F 7/08*** | (2006.01) |
| ***H01H 3/00*** | (2006.01) |
| ***H01H 33/34*** | (2006.01) |
| ***H01H 3/28*** | (2006.01) |
| *H01H 33/666* | (2006.01) |
| *H01H 33/38* | (2006.01) |

(52) U.S. Cl.

CPC ..... *H01H 3/28* (2013.01); *H01H 33/6662* (2013.01); *H01H 33/38* (2013.01)

USPC ..... 335/229; 335/170; 335/177; 335/179; 335/230; 335/279; 335/281; 218/120; 218/140; 218/154

(58) Field of Classification Search

USPC ..... 335/229–230, 279, 281, 78, 85, 335/136–137, 170, 177, 179; 218/1, 7, 14, 218/48, 49, 57, 65, 78, 84, 92, 118, 120, 218/140, 154

See application file for complete search history.

(56) References Cited

U.S. PATENT DOCUMENTS 3,218,523 A * 11/1965 Benson ..... 335/234
3,470,504 A * 9/1969 Rogers et al. ..... 335/78

(Continued)

FOREIGN PATENT DOCUMENTS

EP 1012856 A1 6/2000
EP 0 867 903 B1 5/2004

(Continued)

*Primary Examiner* — Mohamad Musleh
(74) *Attorney, Agent, or Firm* — Steptoe & Johnson LLP

(57) ABSTRACT

An electromagnetic actuator comprising a core moving between a latched position and an open position, a permanent magnet, a coil designed to generate a first magnetic control flux to move the core from an open position to a latched position, and a second magnetic control flux designed to facilitate movement of the moving core from the latched position to the open position. The permanent magnet is positioned on the moving core so as to be at least partly outside the fixed magnetic circuit in which the first magnetic control flux flows in the open position, and to be at least partly inside the fixed magnetic circuit used for flow of a magnetic polarization flux of the magnet in the latched position.

11 Claims, 8 Drawing Sheets

(56) References Cited

U.S. PATENT DOCUMENTS

| | | | | |
|---|---|---|---|---|
| 5,013,223 | A * | 5/1991 | Takahashi et al. | 417/413.1 |
| 5,024,247 | A * | 6/1991 | Lembke | 137/82 |
| 5,883,557 | A * | 3/1999 | Pawlak et al. | 335/179 |
| 5,896,076 | A * | 4/1999 | van Namen | 335/229 |
| 6,020,567 | A | 2/2000 | Ishikawa et al. | |
| 6,040,752 | A * | 3/2000 | Fisher | 335/234 |
| 6,373,675 | B1 | 4/2002 | Yamazaki et al. | |
| 6,472,968 | B1 * | 10/2002 | Ohya | 335/229 |
| 7,982,567 | B2 * | 7/2011 | Cartier Millon et al. | 335/229 |
| 2002/0158727 | A1 * | 10/2002 | Namen | 335/78 |
| 2005/0052265 | A1 * | 3/2005 | Vladimirescu et al. | 335/229 |
| 2007/0200653 | A1 * | 8/2007 | Matsumoto et al. | 335/179 |
| 2008/0164964 | A1 * | 7/2008 | Nelson | 335/229 |
| 2010/0008009 | A1 | 1/2010 | Cartier-Millon et al. | |

FOREIGN PATENT DOCUMENTS

| | | | |
|---|---|---|---|
| GB | 2 325 567 | A | 11/1998 |
| WO | WO 95/07542 | | 3/1995 |
| WO | WO 97/41573 | | 11/1997 |
| WO | WO 2008/135670 | A9 | 11/2008 |

* cited by examiner

ELECTROMAGNETIC ACTUATOR WITH MAGNETIC LATCHING AND SWITCHING DEVICE COMPRISING ONE SUCH ACTUATOR

This application is a national stage entry of International Application No. PCT/FR2010/000760, filed Nov. 15, 2010 designating the U.S., which claims the benefit of French application Ser. No. 09/06168, filed Dec. 18, 2009, and French application Ser. No. 10/03875, filed Sep. 30, 2010.

BACKGROUND OF THE INVENTION

The invention relates to an electromagnetic actuator with magnetic latching comprising a moving core mounted with axial sliding along a longitudinal axis inside a magnetic yoke between a latched position and an open position. The actuator further comprises a permanent magnet and a coil extending axially in the direction of the longitudinal axis of the yoke. The coil is designed to generate a first magnetic control flux to move the moving core from an open position to a latched position and a second magnetic control flux opposing a polarization flux of the permanent magnet and enabling movement of the moving core from the latched position to the open position.

The invention relates to a switching device comprising at least one stationary contact collaborating with at least one movable contact designed to switch the power supply of an electric load.

STATE OF THE PRIOR ART

The use of electromagnetic actuators with magnetic latching for the opening and closing commands of a switching device, in particular of a vacuum cartridge, is known and described in particular in Patents EP0867903B1, U.S. Pat. No. 6,373,675B1.

On account of the geometry of the magnetic circuit of the different known actuators, obtaining the useful forces for movement of the operating mechanisms generally requires the use of operating coils of large size or which deliver a very high electric command power (number of amp-turns) on account of the low efficiency of the electromagnetic actuator.

Furthermore, on account of the positioning of the magnet or magnets in the magnetic circuit, risks of demagnetization of said magnets can be observed. Indeed, as represented in Patent application WO95/07542, when the magnets are placed in series in the magnetic circuit, the magnetic flux generated by the operating coil can counteract that of the magnet and eventually cause demagnetization of said magnets, in particular when opening of the contacts takes place.

Other solutions as described in particular in Patent application WO2008/135670 require very large volumes of magnets to guarantee that the closed position is maintained even when large mechanical shocks occur. These magnets are therefore expensive.

Solutions as described in Patent application WO95/07542 present risks of a stable intermediate position in the absence of a sufficient bias spring. However, it is not desirable to have stable positions of the actuator other than the open and closed positions. To remedy this problem, over-dimensioned bias springs are used for opening of the actuators which involves an additional energy requirement for closing said actuators (inrush phase).

Finally, solutions as described in Patent EP1012856B1 impose the use of two distinct coils, one for closing and the other for opening, thereby imposing an additional cost.

SUMMARY OF THE INVENTION

The object of the invention is therefore to remedy the shortcomings of the state of the technique so as to propose an electromagnetic actuator with a high energy efficiency.

The permanent magnet of the electromagnetic actuator according to the invention is positioned on the moving core so as to be located at least partially outside the fixed magnetic circuit in which the first magnetic control flux flows when the moving core is in an open position, and to be located at least partially inside the fixed magnetic circuit used for flow of the magnetic polarization flux generated by the magnet when the moving core is in a latched position.

According to a first embodiment of the invention, the permanent magnet is magnetized in radial manner in a perpendicular direction to the longitudinal axis of the yoke.

Advantageously, the yoke comprises an inner sleeve extending around the moving core, the permanent magnet being positioned on the moving core in such a way as to be at least partially facing the inner sleeve of the magnetic yoke when the moving core is in a latched position.

Preferably, the sleeve extends over an overlap distance placed in facing manner with the permanent magnet in the latched position.

Preferably, the inner sleeve is separated from the moving core by a sliding radial air-gap remaining uniform during movement of the moving core in translation.

According to a second embodiment of the invention, the permanent magnet is magnetized in axial manner along the longitudinal axis of the yoke.

According to a particular embodiment, the permanent magnet is positioned on the moving core in such a way as to be completely outside the magnetic yoke when the moving core is in an open position.

According to a particular embodiment, the permanent magnet is positioned on the moving core in such a way as to be completely inside the magnetic yoke when the moving core is in an open position.

According to an alternative embodiment, the actuator comprises a cover made from non-ferromagnetic material at the level of an outer surface of the magnetic yoke so as to cover the whole of the moving core in the open position.

According to an alternative embodiment, the moving core comprises a radial surface designed to stick against the magnetic yoke in the latched position, said surface being smaller than a mean cross-section of said core.

The electromagnetic actuator preferably comprises at least one bias spring opposing movement of said core from its open position to its latched position.

According to a particular embodiment, the magnetic moving core is coupled with a non-magnetic actuating member extending along the longitudinal axis.

Advantageously, the electromagnetic actuator comprises a movable sleeve able to be actuated manually or by means of an electromechanical actuator.

The switching device according to the invention comprises at least one electromagnetic actuator as defined above to actuate said at least one movable contact.

BRIEF DESCRIPTION OF THE DRAWINGS

Other advantages and features will become more clearly apparent from the following description of particular embodiments of the invention, given for non-restrictive example purposes only and represented in the accompanying drawings in which.

DETAILED DESCRIPTION OF AN EMBODIMENT

Figures 1A, 1B:
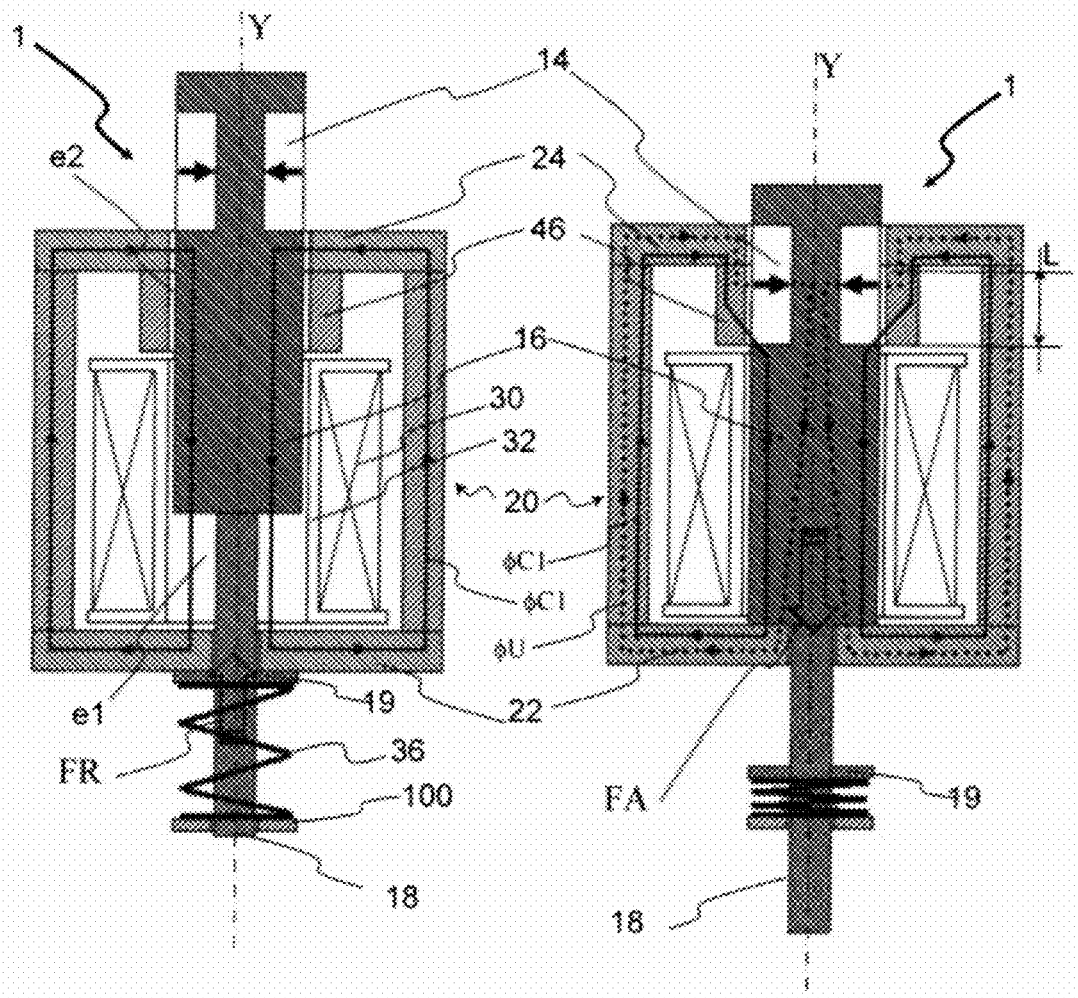
FIGS. 1A and 1B represent cross-sectional views of the electromagnetic actuator in the closing phase in two operating positions according to a first embodiment of the invention.

According to a first embodiment as represented in FIGS. 1A to 1B, the electromagnetic actuator 1 with magnetic latching comprises a fixed magnetic circuit made from ferromagnetic material.

The fixed magnetic circuit comprises a yoke 20 extending along a longitudinal axis Y. The yoke 20 of the magnetic circuit comprises parallel first and second flanges 22, 24 at its opposite ends. The flanges 22, 24 extend perpendicularly to the longitudinal axis Y of the yoke 20.

The yoke 20 is preferably composed of two elongate plates made from ferromagnetic material positioned with respect to one another in such a way as to free an internal volume. The two plates are kept parallel by the first and second flanges 22, 24 respectively placed at the ends of said plates. Said flanges are made from ferromagnetic material. According to a particular embodiment, the yoke 20 of parallelepiped shape comprises at least two surfaces open onto the internal volume.

According to another example embodiment, the two plates and the first flange 22 can be one and the same part obtained by folding, machining or sintering. Furthermore, said flanges could be achieved by a stack of laminated metal plates in order to reduce the induced currents and the associated losses. This assembly can be a parallelepiped or be axisymmetric.

The electromagnetic actuator comprises at least one fixed operating coil 30 preferably fitted on an insulating sheath 32 inside the yoke 20. Said at least one coil extends axially between the first flange 22 and the second flange 24.

The electromagnetic actuator comprises a moving core 16 fitted with axial sliding in the direction of a longitudinal axis of the yoke 20.

The moving core 16 is positioned inside the coil. Movement of the moving core 16 thus takes place inside the operating coil 30 between two operating positions, henceforth called latched position PA and open position PO.

Said at least one coil 30 is designed to generate a first magnetic control flux $\phi C1$ in the magnetic circuit in the open position PO so as to move the moving core 16 from the open position PO to the latched position PA. Furthermore, said at least one coil 30 is designed to generate a second magnetic control flux $\phi C2$ in the magnetic circuit in the latched position PA to facilitate movement of the moving core 16 from its latched position PA to its open position PO.

The moving core 16 is preferably composed of a cylinder made from ferromagnetic material.

A first radial surface of the cylinder is designed to be in contact with the first flange 22 when the coil is in the operating position called latched position PA. A first axial air-gap e1 corresponds to the interval between the first flange 22 and the moving core 16. This air-gap is maximal when the moving core is in the open position PO as represented in FIG. 1A. This air-gap is nil or very small when the moving core is in the latched position PA as represented in FIG. 1B.

A second radial surface of the cylinder is preferably designed to be positioned substantially outside the volume formed by the yoke and the flanges when the core is in the operating position called open position PO.

The moving core 16 comprises a permanent magnet 14. This permanent magnet 14 can be single and/or annular and/or formed by several parallelepipedic magnets placed side by side at the periphery of the core. The thickness of the magnet is calibrated to optimize its magnetic operation knowing that its efficiency is linked to the ratio between its thickness and the air-gap lengths present in the magnetic circuit in the position for which its maximum efficiency is sought for.

The permanent magnet 14 is designed to generate a polarization flux $\phi U$ giving rise to a magnetic latching force FA keeping the moving core 16 secured against the first flange 22 when said core is in the latched position PA.

When the moving core 16 is in the latched position PA, the latter is kept secured against the first flange 22 by the magnetic latching force FA due to a polarization flux $\phi U$ generated by the permanent magnet 14. The moving core 16 is designed to be biased to the open position PO by at least one bias spring 36. The biasing force FR of the bias spring 36 tends to oppose the magnetic latching force FA generated by the permanent magnet 14. In the latched position PA, the intensity of the magnetic latching force FA is higher than the opposing biasing force of said at least one bias spring 36.

In order to guarantee a certain level of shock resistance without the magnetic circuit opening, the magnetic latching force FA is generally calculated so as to oppose not only the biasing force FR but also the detachment forces linked to the impacts and/or to the accelerations undergone by the actuator in the closed position. These detachment forces, which depend on the shock resistance level sought for and on the masses in motion, are added to that of the biasing force FR.

The magnetic moving core 16 is coupled to a non-magnetic actuating member 18 passing axially through an opening 17 made in the first flange 22, the core 16 and actuating member 18 forming the movable assembly of the actuator 1. For example purposes, the non-magnetic actuating member 18 is designed to command a vacuum cartridge.

According to all the embodiments of the invention, the axial position of the magnet 14 on the moving core 16 is achieved in such a way that in the open position PO, said magnet is positioned either totally or partially outside the fixed magnetic circuit used for flow of the first magnetic control flux $\phi C1$ generated by the coil 30. The magnetic polarization flux $\phi U$ of the magnet has little or no influence on closing of the actuator, in particular on the subsequent movement of the core 16 from the open position PO to the latched position PA.

Furthermore, according to all the embodiments of the invention, the axial position of the magnet 14 on the moving core 16 is also achieved in such a way that in the latched position PA, said magnet is positioned either totally or partially inside the fixed magnetic circuit used for flow of the magnetic polarization flux ϕU generated by the magnet 14. The magnetic polarization flux ϕU of the magnet then operates in efficient manner to hold the core 16 in the latched position PA.

According to a first embodiment represented in FIGS. 1A-1B and 2A-2B, magnetization of the permanent magnet 14 is perpendicular to the direction of movement of said core. As represented in FIG. 1A, the magnet is preferably represented totally outside the magnetic circuit used for flow of the first magnetic control flux ϕC1. According to this embodiment, said magnet is placed outside the internal volume of the magnetic yoke. This relative positioning of the magnet 14 with respect to the outer surface of the second flange 24 provides a possibility of dosing the influence of the magnetic flux of the magnet in the closing phase of the actuator. According to this embodiment, the inner surface of the second flange 24 comprises an internal sleeve 46 extending partially in an annular space arranged coaxially around the moving core 16. The moving core 16 is then separated from said sleeve 46 by a second sliding radial air-gap e2 remaining substantially uniform during movement of the moving core 16 in translation. The sleeve 46 preferably covers the moving core 16 over an overlap distance L in the latched position PA. The sleeve 46 is preferably of tubular shape and made from ferromagnetic material. It can form an integral part of the flange or be secured to the latter by fixing means. The sliding air-gap e2 and the overlap distance L between the moving core 16 and the sleeve 46 are adjusted in such a way that the reluctance of the whole of the magnetic circuit 20 is as low as possible over the whole travel of the moving core 16 between the two operating positions. Furthermore, to optimize operation of the magnet in the latched position PA, this distance L has to enable total overlap of the magnet in this position. According to this embodiment of the invention, the bias spring 36 is preferably positioned outside the yoke 20. It comprises a first bearing surface on a first external support such as a frame 100 and comprises a second bearing surface on a stop 19 placed on the actuating member 18. In the open position PO, said stop 19 is pressing on the external second support. For example purposes, the external second support can in particular form part of the outer surface of the first flange 22. This longitudinal positioning of the stop 19 on the actuating member 18 enables the length of movement of the movable assembly of the actuator 1 to be controlled. Securing in the open position is guaranteed by the bias spring.

Said at least one coil 30 is designed to generate a first magnetic control flux ϕC1 in the magnetic circuit in open position PO, which tends to oppose the action of the bias spring 36 so as to move the moving core 16 from its open position PO to its latched position PA. FIGS. 1A and 1B respectively represent the actuator on the one hand at the beginning of the closing phase and on the other hand at the end of the closing phase.

Figures 2A, 2B:
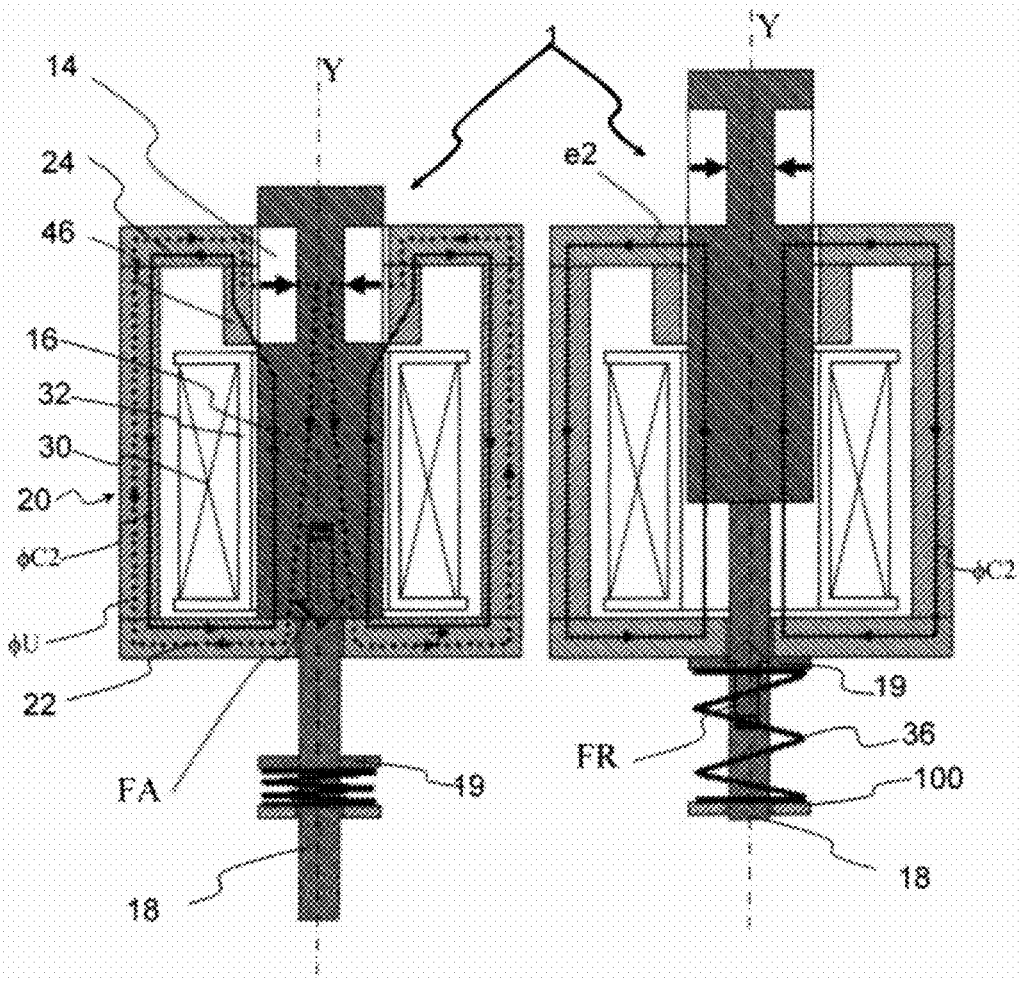
FIGS. 2A and 2B represent cross-sectional views of the electromagnetic actuator in the opening phase in two operating positions according to a first embodiment of the invention.

Said at least one coil 30 is also designed to generate a second magnetic control flux ϕC2 in the magnetic circuit in the latched position PA, which opposes the polarization flux ϕU of the permanent magnet 14 so as to release the moving core 16 and to enable movement of the latter from the latched position PA to the open position PO. FIGS. 2A and 2B respectively represent the actuator on the one hand at the beginning of the opening phase and on the other hand at the end of the opening phase. Movement of the moving core 16 from the latched position PA to the open position PO takes place due to the action of said at least one bias spring 36.

Figures 3A, 3B:
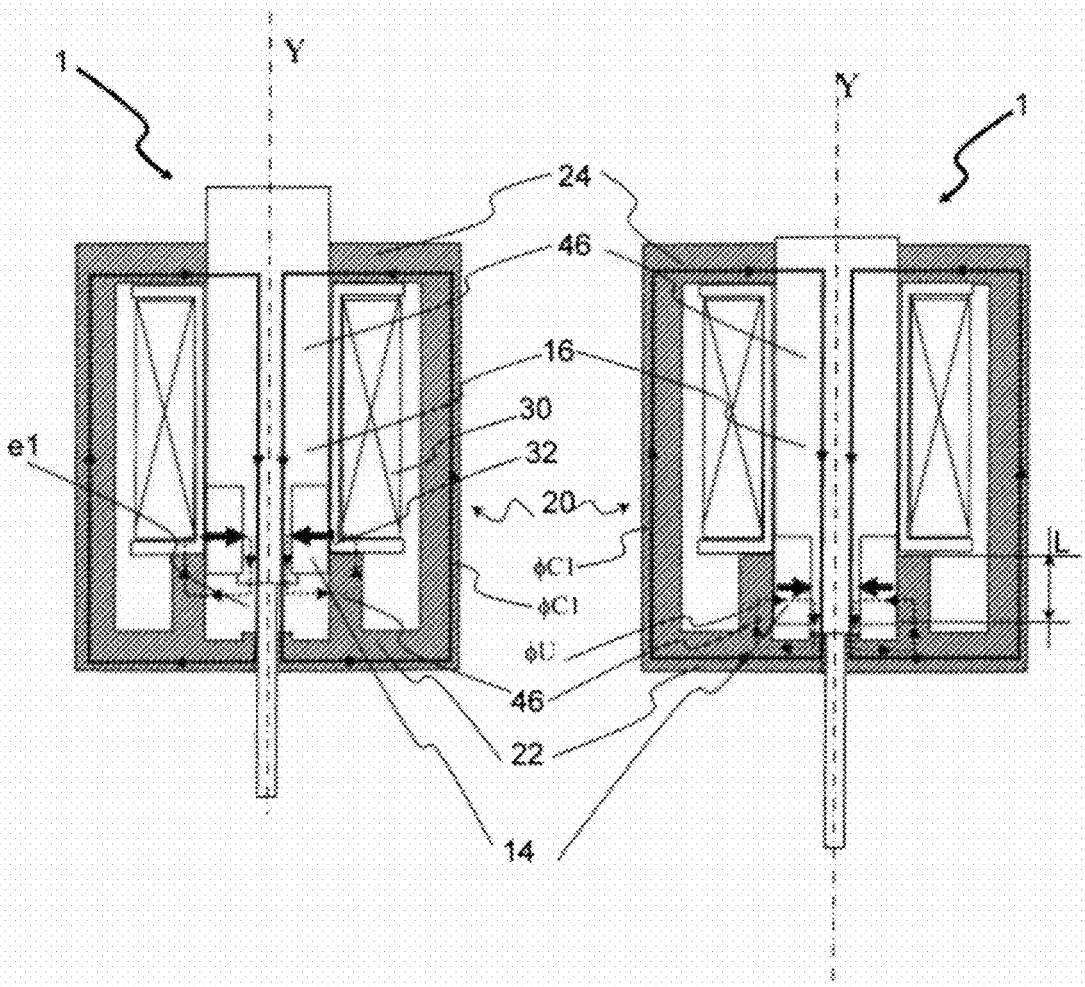
FIGS. 3A and 3B represent cross-sectional views of the electromagnetic actuator in the closing phase in two operating positions according to an alternative embodiment according to FIGS. 1A and 1B.

According to a variant of the first embodiment as represented in FIGS. 3A and 3B, the magnet 14 with radial magnetization is positioned outside the fixed magnetic circuit used for flow of the first magnetic control flux ϕC1 while at the same time being placed inside the internal volume of the magnetic yoke. The magnetic polarization flux ϕU of the magnet has little or no influence on closing of the actuator, in particular on subsequent movement of the core 16 from the open position PO to the latched position PA. According to this embodiment, said magnet is always inside the internal volume of the yoke 20 of the actuator whatever the operating position of the core. In the latched position and in the open position, the magnet is thereby protected against external manifestations. The cross-section of the core that comes into contact with the magnetic circuit in the closed position is small compared with the cross-section of said core. The reluctance of the magnetic circuit in the closed position is thus reduced, which enables the efficiency of the actuator to be improved while at the same time reducing the opening and closing energies. A value of the contact surface between the core and the first flange is thus adaptable according to requirements.

Figure 6:
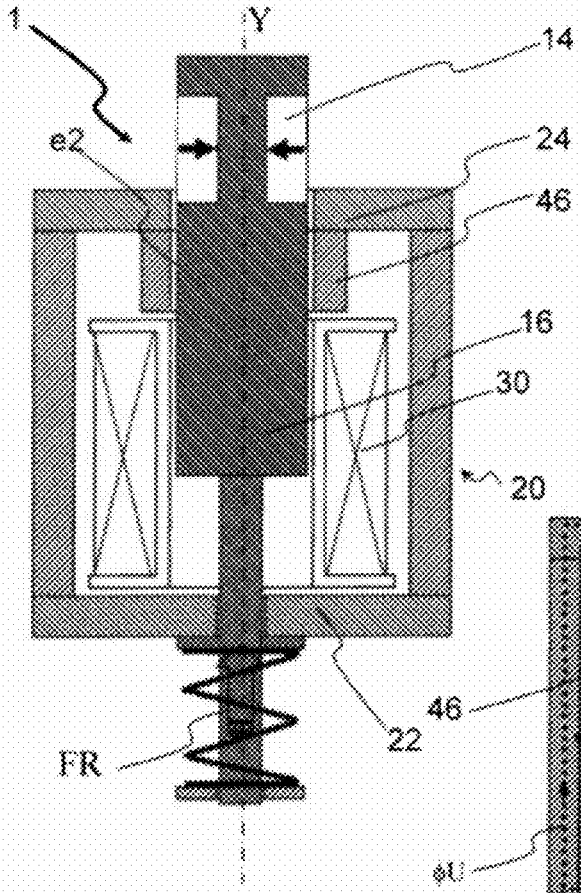
FIGS. 6 and 7 represent cross-sectional views of alternative embodiments of the electromagnetic actuator according to FIGS. 1A and 2A.

According to a second variant of the first embodiment as represented in FIG. 6, in the open position PO, a minority part of the magnet is positioned partially in the in magnetic circuit used for flow of the magnetic control flux ϕC1. A minority part of the magnet is placed inside the internal volume of the magnetic yoke. Furthermore, the magnet is preferably represented partially in the magnetic circuit in such a way that the polarization flux ϕU of the magnet flows in the magnetic circuit and thereby participates in closing the electromagnetic actuator 1.

Figure 7:
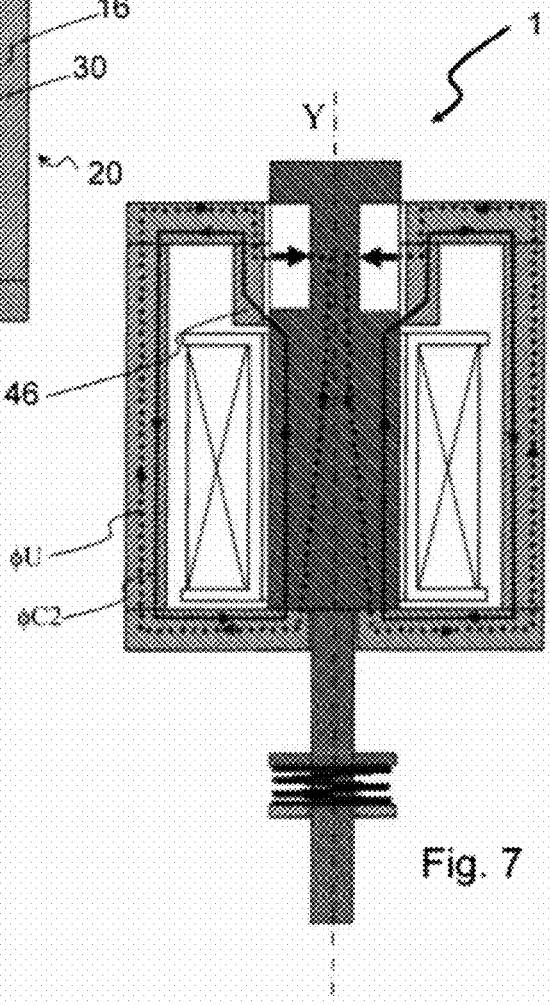

According to another variant of the first embodiment as represented in FIG. 7, the magnet 14 is positioned in the latched position PA in such a way that part of the second control flux ϕC2 of the coil opposes the polarization flux ϕU of the magnet 14 without flowing through the latter. The efficiency of the operating coil 30 increases. A minority part of the magnet is positioned in the magnetic circuit used for flow of the second magnetic control flux ϕC2. As represented, in the latched position PA, a part of the sleeve 46 extends beyond the magnet. This variant does however facilitate local reclosing of the polarization flux ϕU of the magnet 14 thereby reducing its efficiency. Moreover, according to a particular embodiment of this variant that is not represented, the part of the sleeve 46 extending beyond the magnet is separated from the core by a sliding air-gap of adjustable thickness. This adjustable air-gap in particular makes it possible to prevent short-circuiting of the flux of the magnet when the core is in the latched position PA.

All the variants described in the foregoing can be developed in independent manner or simultaneously.

Figures 4A, 4B:
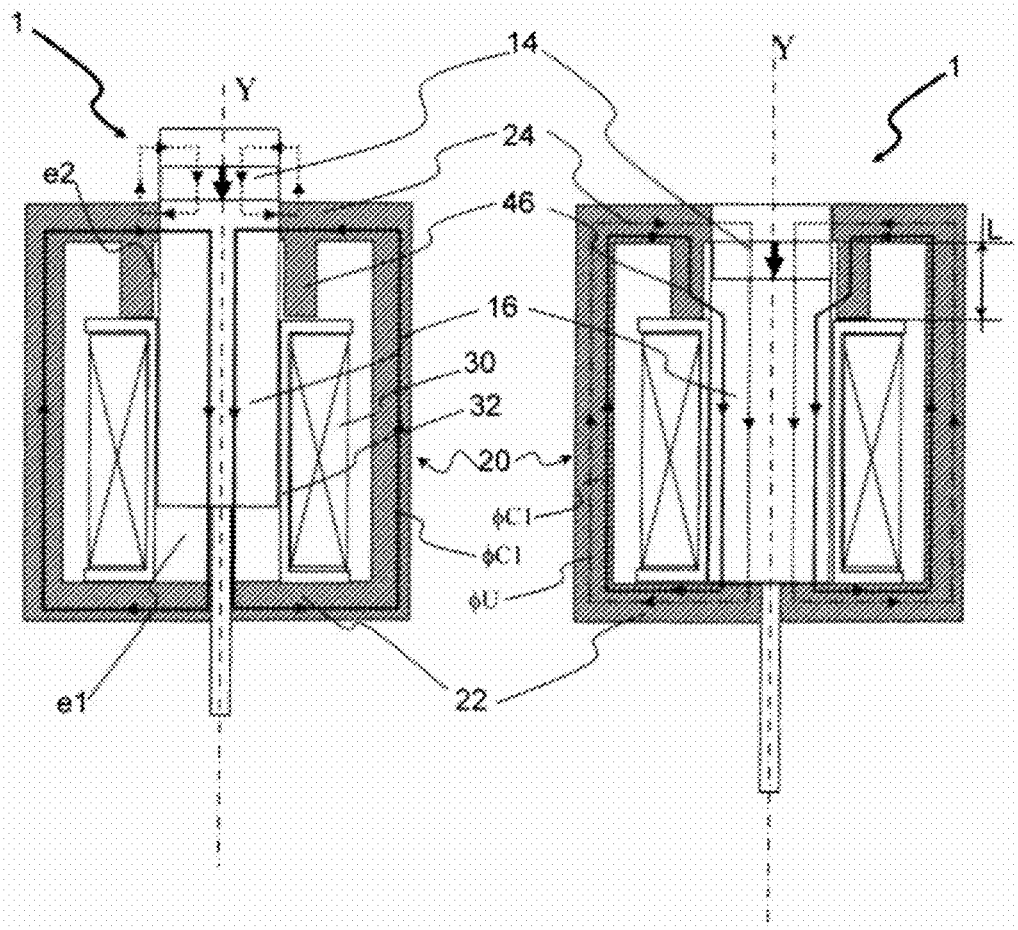
FIGS. 4A and 4B represent cross-sectional views of the electromagnetic actuator in the closing phase in two operating positions according to a second embodiment of the invention.

According to a second embodiment of the invention as represented in FIGS. 4A and 4B, the permanent magnet 14 has a magnetization aligned along the direction of movement of said core. Said magnet is represented totally outside the magnetic circuit used for flow of the first magnetic control flux ϕC1. According to this embodiment, said magnet is preferably placed outside the internal volume of the magnetic yoke. This relative positioning of the magnet 14 with respect to the outer surface of the second flange 24 provides a possibility of dosing the influence of the magnetic flux of the magnet in the closing phase of the actuator. According to this embodiment, the inner surface of the second flange 24 comprises an internal sleeve 46 extending partially in an annular space arranged coaxially around the moving core 16. The moving core 16 is then separated from sleeve 46 by a second sliding radial air-gap e2 remaining substantially uniform during movement of the moving core 16 in translation.

Preferably, as represented in FIG. 4B, the sleeve 46 covers the moving core 16 over an overlap distance L in the latched position PA. The sleeve 46 is preferably of tubular shape and made from ferromagnetic material. It can form an integral part of the flange or be secured to the latter by fixing means. The sliding air-gap e2 and the overlap distance L between the moving core 16 and sleeve 46 are adjusted in such a way that the first magnetic control flux ϕC1 generated by the coil does not flow through the magnet throughout the closing phase, i.e. when the core moves from the open position PO to the latched position PA.

Figures 5A, 5B:
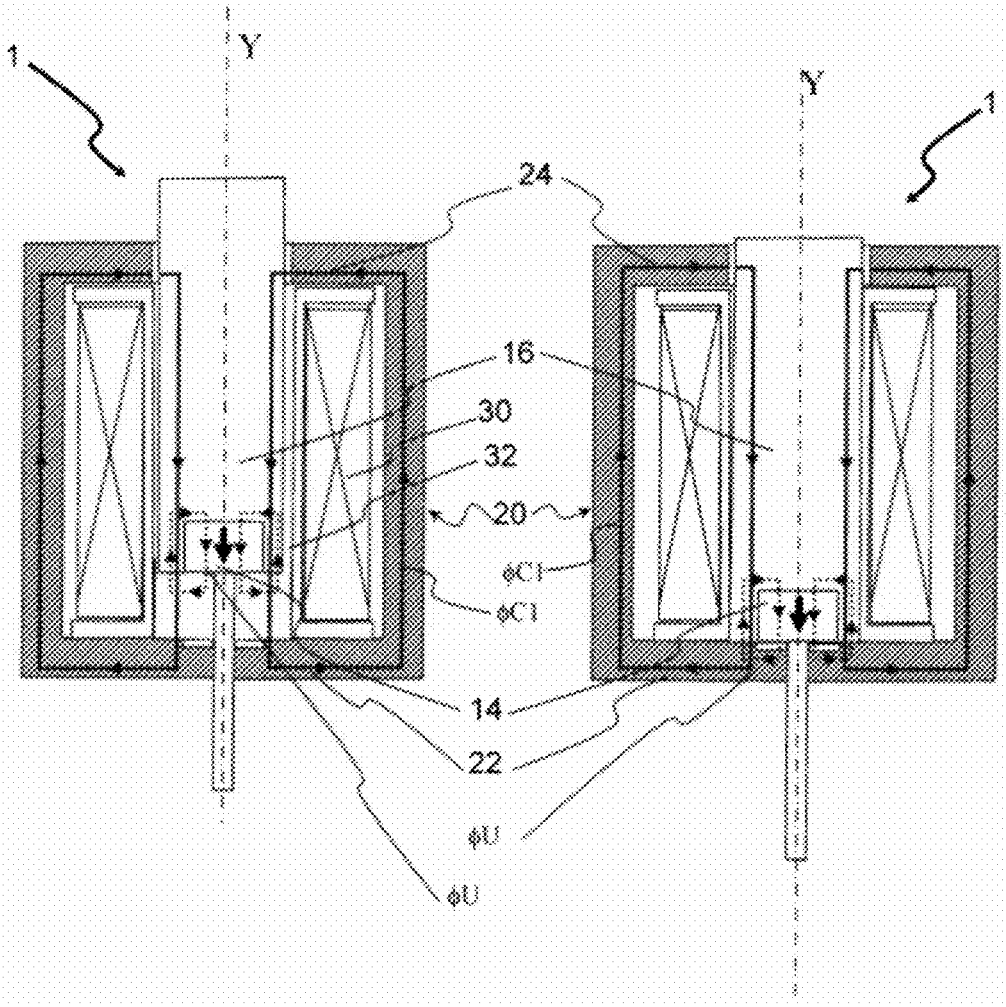
FIGS. 5A and 5B represent cross-sectional views of the electromagnetic actuator in the closing phase in two operating positions according to an alternative embodiment according to FIGS. 1A and 1B.

According to a variant of the second embodiment as represented in FIGS. 5A and 5B, the magnet 14 with axial magnetization is positioned outside the fixed magnetic circuit used for flow of the first magnetic control flux ϕC1 while at the same time being placed inside the internal volume of the magnetic yoke. The magnetic polarization flux ϕU of the magnet has little or no influence in closing of the actuator, in particular in movement of the core 16 from the open position PO to the latched position PA. According to this embodiment, said magnet is always inside the internal volume of the yoke 20 of the actuator whatever the operating position of the core. In the latched position PA and in the open position PO, the magnet is thus protected from external manifestations. The cross-section of the core that comes into contact with the magnetic circuit in the closed position is small compared with the cross-section of said core. The reluctance of the magnetic circuit in the closed position is thereby reduced, which enables the efficiency of the actuator to be enhanced while at the same time reducing the opening and closing energies. A value of the contact surface between the core and the first flange is thus adaptable according to requirements. In order not to increase the reluctance of the moving core 16 and to reduce the energy efficiency of the actuator, said core comprises a magnetic shunt. In other words, the magnet is formed by a ring or a disc of smaller cross-section than that of the core. Furthermore, due to the presence of the magnetic shunt, the risks of demagnetization of the magnet are greatly reduced.

According to a non-represented variant of the first and second embodiments, the magnet is then preferably replaced by a portion of magnetizable material such as hard steel of ALNICO type.

Figure 12:
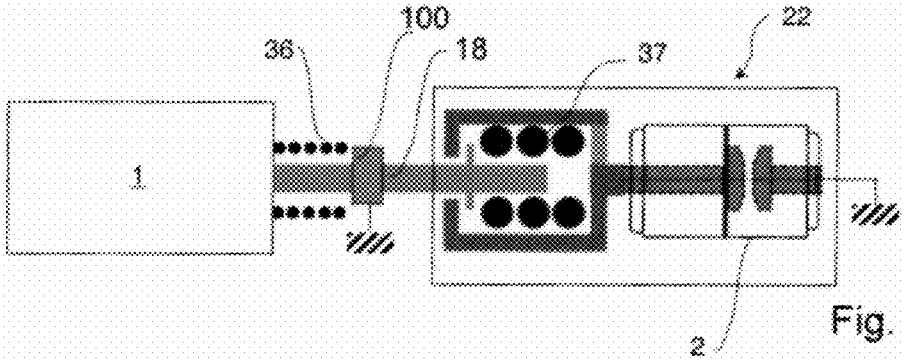
FIG. 12 represents a view of a synoptic diagram of the electromagnetic actuator coupled with a switching device.

The invention relates to a switching device 22 comprising an electromagnetic actuator 1 as defined in the foregoing. As represented in FIG. 12 and as an example embodiment, the switching device 22 is a circuit breaker comprising in particular at least one cartridge 2. This cartridge 2 can be a vacuum cartridge or a conventional circuit breaker arc extinguishing chamber. To move from an open position to a closed position of the contacts of said at least one cartridge 2, operation of the electromagnetic actuating device 1 is as follows. A first opening force FR applied by the bias spring 36 on the moving core 16 by means of a non-magnetic actuating member 18 tends to hold the moving core 16 in an open position, the contacts being in the open position. When power is supplied to the coil 30, the latter generates a first control flux ϕC1 then producing an electromagnetic closing force. As soon as this closing force FFE is higher than the first opening force FR, the moving core 16 moves from its open position PO to its latched position PA. After a certain travel corresponding to opening of the contacts, this core encounters a second opening force FP corresponding to the pressure force applied on the contacts of said at least one cartridge 2. The core will then have to compress these contact pressure springs 37 over a travel remaining to be covered in order to obtain the latched position PA and corresponding to the wear clearance of the contacts. The work accumulated and stored by the core when the latter moves from the open position to the impact position of the poles then has to be sufficient to guarantee clear and frank closing (without stopping) of the contacts in order to prevent risks of welding of the latter. It is for this reason that the respective values of the second opening force FR, of the opening travel and of the power input to the coil have to be optimized so as to obtain this clear and frank closing of the core.

When the moving core 16 is in the latched position PA as represented for example in FIG. 1B, the power supply of the coil is interrupted. The magnetic latching force FA due to the polarization flux ϕU of the magnet 14 is then of greater intensity than the sum of the bias forces linked to the first and second opening forces FR and FP.

The magnetic latching force FA is generally calculated so as on the one hand to oppose the first and second opening forces FR and FP and on the other hand to oppose the detachment forces linked to the shocks undergone by the actuator in the closed position. The detachment forces are to be added to those of the first and second opening forces FR and FP.

To go from a closed position to an open position of the contacts of said at least one cartridge 2, in other words from the latched position PA to the open position PO of the moving core 16, operation of the electromagnetic actuating device 1 is as follows. Two opposing forces are applied on the moving core 16: a magnetic latching force FA due to the polarization flux ϕU of the magnet 14 and to the sum of the opening forces FR, FP resulting from the forces applied by the bias springs 36 and of the pole pressure springs 37. The magnetic latching force FA is then of higher intensity than the opening forces FR+FP.

The operating coil 30 is then supplied to generate a second control flux. This second control flux flows in an opposite direction from the polarization flux ϕU of the magnet 14 to thereby reduce the magnetic latching force FA. As soon as the resulting opening force (FR+FP) exceeds the magnetic latching force FA, the moving core 16 moves from its latched position PA to its open position PO thereby causing opening of the contacts. This opening takes place in clean and continuous manner on account of the actual geometry of the actuator itself that does not present any stable intermediate position.

Figure 11A:
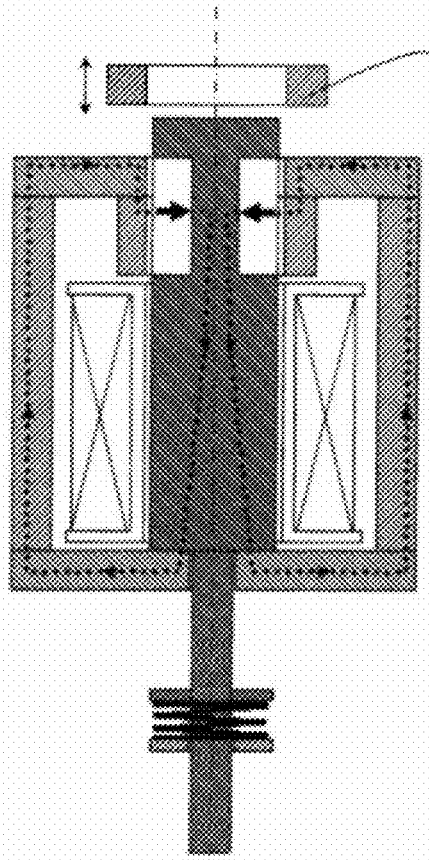
FIGS. 11A and 11B represent cross-sectional views of an alternative embodiment of the electromagnetic actuator in the closed position according to FIG. 1A.
Figure 11B:
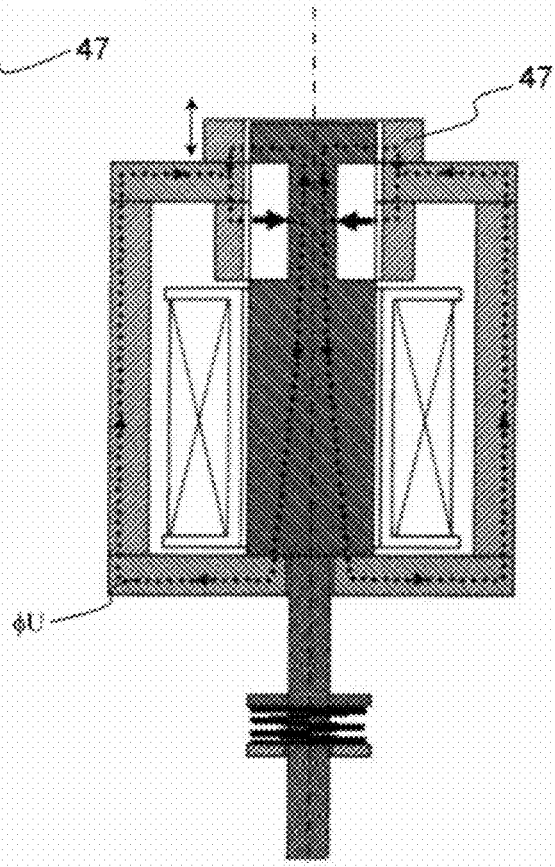

According to an alternative embodiment as represented in FIGS. 11A and 11B, the electromagnetic actuator comprises a movable sleeve 47 made from ferromagnetic material. The longitudinal axis of said sleeve coincides with that of the moving core 16. As represented in FIG. 11A, said sleeve is positioned in a first operating position so as not to form part of the magnetic circuit and so that the polarization flux ϕU of the magnet 14 does not flow through the sleeve when the actuator is in its open position PO. As represented in FIG. 11B, said sleeve can be positioned in a second operating position so as to form part of the magnetic circuit when the actuator is in its latched position PA. As an example embodiment, the movable sleeve 47 is in this second position, pressing against the outer surface of the second flange 24. In this second position, the sleeve enables a part of the flux of the magnet 14 to be diverted thereby reducing its efficiency as far as holding of the moving core 16 in the latched position PA is concerned, and thereby allowing movement of the moving core 16 from its latched position PA to its open position PO. Movement of the movable sleeve 47 can be actuated by means of a mechanism that is controlled manually when the energy necessary for re-opening of the actuator is lacking. Movement of the movable sleeve 47 could also be achieved by means of an electromagnetic actuator. The coil of said actuator can be commanded instead of the coil 30 to perform opening of the core.

In case of command of at least one vacuum cartridge or of a circuit breaker by the main actuator that forms the subject of this patent, the second actuator enabling movement of the sleeve can also be commanded in case of an overload or short-circuit fault in the electric installation protected by the at least one cartridge or the circuit breaker.

Figure 9:
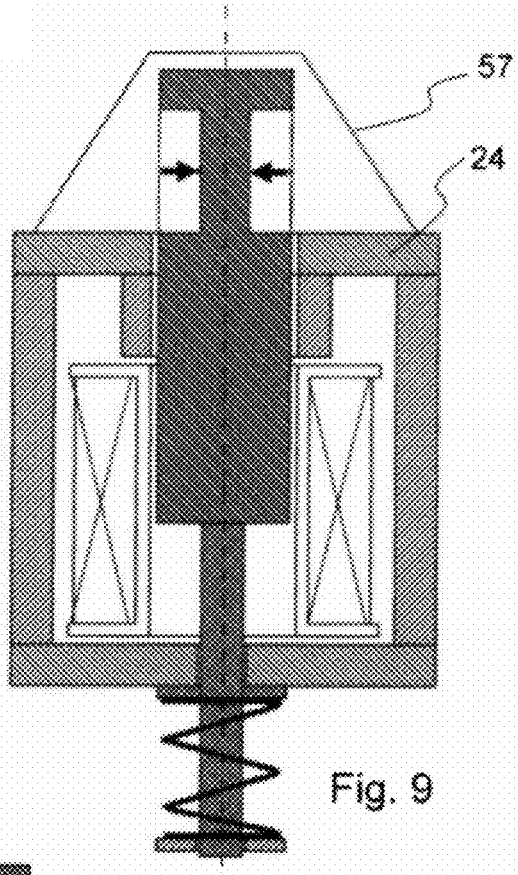

According to another alternative embodiment as represented in FIG. 9, a non-magnetic cover 57 is positioned at the level of the outer surface of the second flange 24 so as to protect the magnet from metallic or non-metallic dusts.

Figure 8:
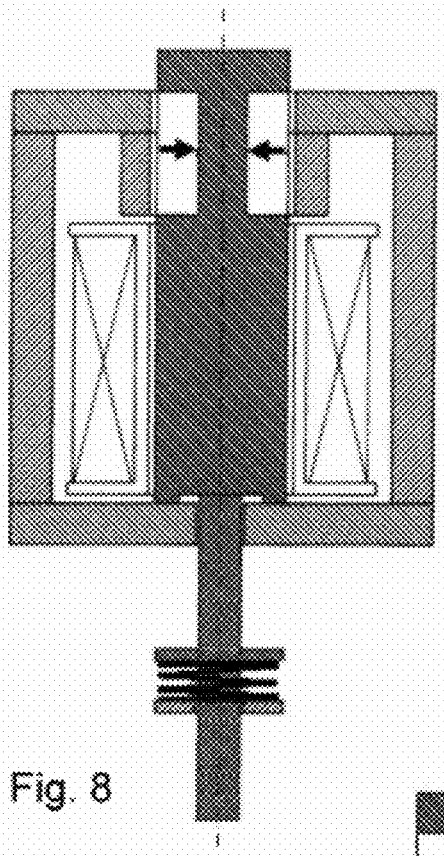
FIGS. 8, 9 and 10 represent cross-sectional views of alternative embodiments of the electromagnetic actuator according to the embodiments of the invention.

According to an alternative embodiment as represented in FIG. 8, the cross-section of the moving core 16 at its end placed on the side where the first flange 22 is located can be reduced over a small height for the purposes of increasing the holding force of the magnet 14. This reduction can be made in the axis of the core or at the periphery of the latter. The particular location of this reduction of cross-section of the core enables the sticking force of the core 16 to be increased without impairing its efficiency when closing movement of the latter takes place from the open position PO to the latched position PA.

Figure 10:
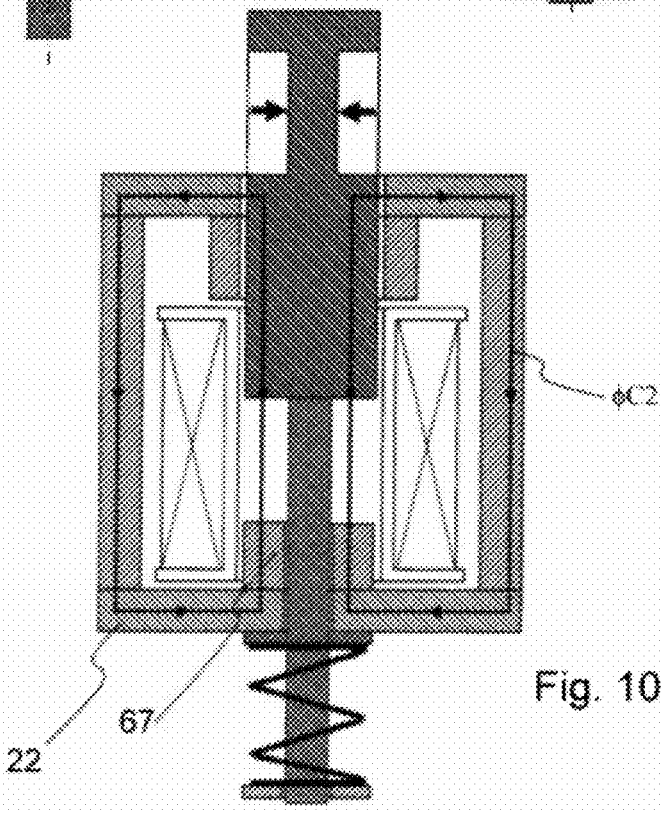

According to an alternative embodiment as represented in FIG. 10, the electromagnetic actuator comprises a fixed core 67 placed inside the internal volume of the magnetic yoke against the inner surface of the first flange 22. The fixed core 67, made from ferromagnetic material, may form an integral part of said flange or not. The fixed core 67 increases the efficiency of the operating coil by concentrating the flux of the latter.

According to all the embodiments involved, the core can present the shape of a parallelepiped. The electromagnetic actuator can further comprise geometries having asymmetric shapes.

The invention claimed is:

1. An electromagnetic actuator comprising:

a moving core mounted for axial sliding along a longitudinal axis inside a magnetic yoke between a latched position and an open position, at least one permanent magnet surrounding one end of the moving core, at least one coil in the yoke and extending axially in the direction of the longitudinal axis of the yoke and coaxial with the moving core, for generating:

a first magnetic control flux in a fixed magnetic circuit to move the moving core from an open position to a latched position, and a second magnetic control flux opposing a polarization flux of the permanent magnet and enabling movement of the moving core from the latched position to the open position, wherein when the moving core is in the open position the permanent magnet is positioned on the moving core to be at least partly outside the fixed magnetic circuit in which the first magnetic control flux flows so that no first magnetic control flux can flow into said permanent magnet, and when the moving core is in the latched position the permanent magnet is positioned more inside the fixed magnetic circuit than in the open position to permit flow of the magnetic polarization flux generated by the magnet when the moving core is in the latched position.

2. The electromagnetic actuator according to claim 1, wherein the permanent magnet is magnetized in radial manner perpendicular to the longitudinal axis of the magnetic yoke.

3. The electromagnetic actuator according to claim 1, wherein the magnetic yoke comprises an internal sleeve extending around the moving core, the permanent magnet being positioned on the moving core at least partially facing the internal sleeve of the magnetic yoke when the moving core is in the latched position.

4. The electromagnetic actuator according to claim 3, wherein the internal sleeve extends over an overlap distance placed facing the permanent magnet in the latched position.

5. The electromagnetic actuator according to claim 3, wherein the internal sleeve is separated from the moving core by a radial air-gap that remains uniform during axial sliding of the moving core.

6. The electromagnetic actuator according to claim 1, wherein the permanent magnet is magnetized axially aligned with the longitudinal axis of the yoke.

7. The electromagnetic actuator according to claim 1, wherein the permanent magnet is positioned on the moving core to be completely outside the magnetic yoke when the moving core is in the open position.

8. The electromagnetic actuator according to claim 7, comprising a movable sleeve that may be actuated either manually or electromechanically, wherein the movable sleeve is positioned at one end of the electromagnetic actuator and the longitudinal axis of the movable sleeve coincides with that of the moving core.

9. The electromagnetic actuator according to claim 1, wherein the permanent magnet is positioned on the moving core completely inside the magnetic yoke when the moving core is in the open position.

10. The electromagnetic actuator according to claim 1, comprising a cover of non-ferromagnetic material adjacent to an outer surface of the magnetic yoke to cover entirely the moving core when it is in the open position.

11. The electromagnetic actuator according to claim 7, wherein the moving core comprises a radial surface for contacting the magnetic yoke in the latched position, said surface being smaller than a mean cross-section of said core.

* * * * *